US010037670B2

(12) United States Patent
Lin et al.

(10) Patent No.: US 10,037,670 B2
(45) Date of Patent: Jul. 31, 2018

(54) ELECTRIC SAFETY BELT

(71) Applicants: Michelle Jing Lin, Irvive, CA (US); Eric Xin Lin, Irvine, CA (US); Haitao Lin, Irvine, CA (US); Jiali Li, Irvine, CA (US)

(72) Inventors: Michelle Jing Lin, Irvive, CA (US); Eric Xin Lin, Irvine, CA (US); Haitao Lin, Irvine, CA (US); Jiali Li, Irvine, CA (US)

( * ) Notice: Subject to any disclaimer, the term of this patent is extended or adjusted under 35 U.S.C. 154(b) by 0 days.

(21) Appl. No.: 15/298,133

(22) Filed: Oct. 19, 2016

(65) Prior Publication Data

US 2017/0109992 A1 Apr. 20, 2017

Related U.S. Application Data

(60) Provisional application No. 62/243,587, filed on Oct. 19, 2015.

(51) Int. Cl.

| | |
|---|---|
| ***G08B 23/00*** | (2006.01) |
| ***G08B 21/04*** | (2006.01) |
| ***G08B 7/06*** | (2006.01) |
| ***A41F 9/00*** | (2006.01) |
| ***A41D 27/08*** | (2006.01) |

(52) U.S. Cl.

CPC ..... *G08B 21/0438* (2013.01); *A41D 27/085* (2013.01); *A41F 9/002* (2013.01); *G08B 7/06* (2013.01)

(58) Field of Classification Search

CPC ..... G06F 3/016; G06F 3/017; G06F 3/04842; G06F 17/28; G06F 17/30247; G06F 17/30557; G06F 17/30864; G06F 21/00; G06F 21/31; G06F 21/32; G06F 3/0481; G06F 3/0488; G06F 8/65; G06F 3/04886

USPC ..... 340/573.1, 438, 573.4, 573.3, 573.7, 340/825.06, 825.49, 539, 425.5, 426

See application file for complete search history.

(56) References Cited

U.S. PATENT DOCUMENTS

| | | | | |
|---|---|---|---|---|
| 3,840,853 | A | 10/1974 | Cukale | |
| 6,396,403 | B1 | 5/2002 | Haner | |
| 2010/0010774 | A1* | 1/2010 | Ma | G01C 22/006 702/160 |
| 2010/0277943 | A1* | 11/2010 | Hurwitz | A01K 27/006 362/555 |
| 2011/0190593 | A1* | 8/2011 | McNair | A61B 5/00 600/300 |

(Continued)

OTHER PUBLICATIONS https://web.archive.org/web/20160513125915/https://learn.sparkfun.com/tutorials/apds-9960-rgb-and-gesture-sensor-hookup-guide (for NPL titled "APDS-9970 RGB and Gesture Sensor Hookup Guide", Wayback Machine date May 13, 2016; pulled Dec. 26, 2017).

(Continued)

*Primary Examiner* — Daniel Previl
(74) *Attorney, Agent, or Firm* — Fish IP Law, LLC

(57) ABSTRACT

Systems and methods of a safety belt to be worn by individuals in the course of physical activities such as walking, running, biking, etc. Safety belts of the inventive subject matter include one or more sensors that are used to develop a kinematic status of the individual wearing the safety belt. Kinematic status information can be broadcast out wirelessly, and it can be used to determine whether to generate an alert. Some embodiments of the safety belt can detect the presence of a hazard in the vicinity of an individual wearing the safety belt.

15 Claims, 12 Drawing Sheets

(56) References Cited

U.S. PATENT DOCUMENTS

| | | | | |
|---|---|---|---|---|
| 2013/0033372 | A1* | 2/2013 | Medel | B60R 22/48 340/438 |
| 2014/0296669 | A1* | 10/2014 | Gertsch | A61B 5/6803 600/324 |
| 2015/0141873 | A1* | 5/2015 | Fei | A61B 5/112 600/595 |
| 2015/0258302 | A1* | 9/2015 | Chandra | A61M 21/02 600/27 |
| 2015/0332563 | A1* | 11/2015 | Davis | G08B 5/006 342/66 |
| 2016/0198995 | A1* | 7/2016 | Yeung | A61B 5/4528 600/595 |

OTHER PUBLICATIONS https://web.archive.org/web/20161003031611/https://www.indiegogo.com/projects/aster-world-s-safest-cycling-backpack#/ (for NPL "Aster—World's safest cycling backpack"; Wayback Machine date Oct. 3, 2016; pulled Dec. 26, 2017).

https://web.archive.org/web/20150908081239/https://www.indiegogo.com/projects/livall-the-first-smart-and-safe-cycling-helmet#/story (for NPL "Livall: the first smart and safet cycling helmet"—Wayback date Sep. 8, 2015; pulled Dec. 26, 2017).

https://web.archive.org/web/20160313111527/http://lumoshelmet.co/ (for NPL Lumos; Wayback date Mar. 13, 2016; pulled Dec. 26, 2017).

* cited by examiner

ELECTRIC SAFETY BELT

This application claims the benefit of priority to U.S. Provisional Application 62/243,587 filed Oct. 19, 2015, the contents of which are incorporated by reference in their entireties. Where a definition or use of a term in a reference that is incorporated by reference is inconsistent or contrary to the definition of that term provided herein, the definition of the term provided herein is deemed to be controlling.

FIELD OF THE INVENTION

The field of the invention is electronic safety belts.

BACKGROUND OF THE INVENTION

All publications identified in this application are incorporated by reference to the same extent as if each individual publication or patent application were specifically and individually indicated to be incorporated by reference. Where a definition or use of a term in an incorporated reference is inconsistent or contrary to the definition of that term provided in this application, the definition of that term provided in this application applies and the definition of that term in the reference does not apply.

A number of efforts have been made to develop personal safety devices. Although some safety belts exist, these efforts leave room for improvement. For example, U.S. Pat. No. 3,840,853 discloses a belt that can be worn by cyclists, but the safety belt fails to account for technological improvements that have been made in electronics since its conception.

More recently, U.S. Pat. No. 6,396,403 describes a child monitoring system. But this fails to take into consideration features that are specific to wearable devices for activities like biking and walking.

Thus, an improved safety belt is needed.

SUMMARY OF INVENTION

In one aspect of the inventive subject matter, a safety belt to improve visibility of an individual is contemplated. The safety belt includes at least a strap, a multi-functional light source coupled to the strap, and a sensor that is informationally coupled with the multi-functional light source. When in use, the sensor detects and kinematic status of the individual wearing the safety belt, and based on that kinematic status, the sensor generates a signal that causes the multi-functional light source to indicate the kinematic status.

In some embodiments, the safety belt additionally includes a wireless communication device communicatively that is informationally coupled with the sensor and configured to broadcast the kinematic status (e.g., to other devices such as mobile devices, computers, wearables, and the like). Safety belts of the inventive subject matter can include one or more sensors, including one or more of a GPS (Global Positioning System) sensor, an accelerometer, a photosensor (e.g., a sensor that detects one or more of visible light, infrared light, and ultraviolet (UV) radiation), and a gyroscope. The sensor or sensors are used to determine a kinematic status of the safety belt wearer. Kinematic status can be an acceleration, a velocity, a position, an angular acceleration, an angular velocity, and an angular position. It can also be a change in at least one of an acceleration, a velocity, a position, an angular acceleration, an angular velocity, and an angular position.

In some embodiments, the multi-functional light source can be an array of LEDs or digital display (e.g., an LCD screen). Second and third multi-functional light sources (e.g., light sources that are located on the left and right sides of the strap when it is worn by an individual) can also be coupled to the safety belt. These light sources can also be an array of LEDs or digital display (e.g., an LCD screen).

In another aspect of the inventive subject matter, the inventors contemplate a method of improving visibility of an individual wearing a safety belt. The method includes the steps of: (1) detecting, using a sensor coupled to the safety belt, a kinematic status of the individual, and (2) activating a multi-functional light source based on the kinematic status, where the multi-functional light source is informationally coupled to the sensor so that the multi-functional light source indicates the kinematic status of the individual. In some embodiments, the method additional includes the step of wirelessly broadcasting the kinematic status of the individual via a wireless communication device.

As with the safety belt described above, the safety belt of this method can include one or more of a GPS sensor, an accelerometer, a photosensor (e.g., a sensor that detects one or more of visible light, infrared light, and ultraviolet (UV) radiation), and a gyroscope. Kinematic status can be an acceleration, a velocity, a position, an angular acceleration, an angular velocity, and an angular position. It can also be a change in at least one of an acceleration, a velocity, a position, an angular acceleration, an angular velocity, and an angular position.

In some embodiments of the method, the multi-functional light source can be an array of LEDs or digital display (e.g., an LCD screen). Second and third multi-functional light sources (e.g., light sources that are located on the left and right sides of the strap when it is worn by an individual) can also be coupled to the safety belt. These light sources can also be an array of LEDs or digital display (e.g., an LCD screen).

In another aspect of the inventive subject matter, a method of detecting a hazard using a safety belt worn by an individual is contemplated. The method includes the steps of: (1) collecting sensor information from at least one sensor (e.g., a light sensor, a camera, a thermal sensor, a radar sensor, an acoustic distance sensor, and a passive infrared sensor (PIR)), where the sensor information is related to environment surrounding the safety belt; (2) interpreting the sensor information to determine whether the hazard is a threat to the individual; and (3) alerting the individual of the hazard by actuating a vibrating mechanism, a speaker, a multi-function light source, or some combination thereof. In some embodiments, the method can include the additional step of broadcasting the alert via a wireless communication module.

DESCRIPTION OF THE INVENTION

The inventive subject matter is directed to a safety belt designed to indicate the kinematic status of an individual wearing the safety belt based on inputs and conditions from the user and the user's environment. The safety belt includes, sensors, an onboard computer, and one or more multi-functional light source, which can work together to create different effects. An embodiment of a safety belt according to the inventive subject matter can be seen in FIGS. 1A-1C. In this application, all components discussed as being included in various embodiments of the safety belt (e.g., sensors, onboard computers, etc.) are integrated into those embodiments of the safety belt.

In some embodiments, the strap portion of the belt is not included. In those embodiments, each multi-function light source can include all of the necessary sensors and computing components (e.g., an onboard computer and associated technologies) to facilitate normal function as described in association with the safety belt throughout this application. In some embodiments, only the rear facing multi-function light source is included, while in others the right and left side multi-function light sources are included with the rear facing multi-function light source.

Safety belts of the inventive subject matter perform a variety of tasks including: detecting and indicating acceleration, detecting and signaling turning (e.g., for cyclists), sensing environmental conditions (e.g., determining that an object such as a car or person is approaching the safety belt wearer), detecting position (e.g., via GPS), and wirelessly interfacing with other devices (e.g., other safety belts as well as computing devices such as mobile devices).

The safety belt can include a variety of different features. For example, some embodiments of the safety belt include: GPS, wireless networking, automatic turn signaling, acceleration sensing, and environmental sensing. Additionally or alternatively, other features can be included with the safety belt such as additional sensors, clocks, timers, stopwatches, and different modes (e.g., bike riding, walking, running, swimming, motorcycle riding, horseback riding, etc.).

Figure 1A:
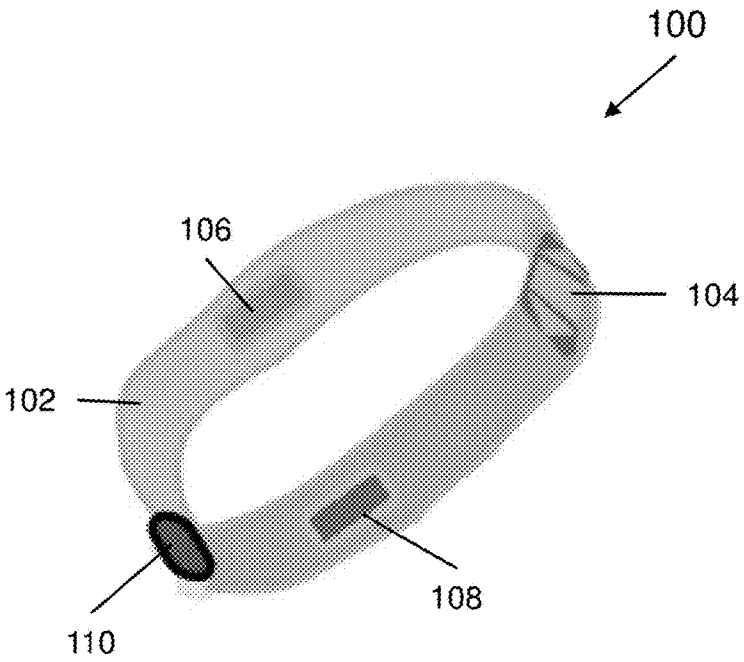
FIG. 1A shows an embodiment of a safety belt.
Figure 1B:
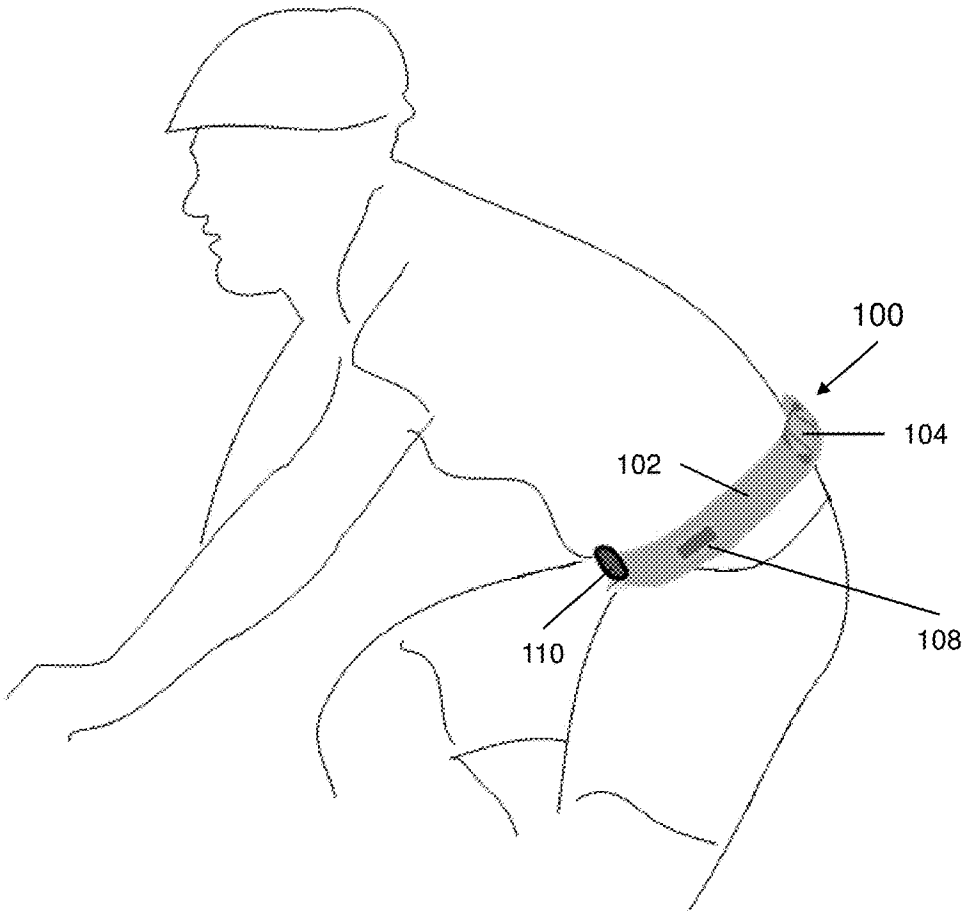
FIG. 1B shows an embodiment of a safety belt as it would appear on an individual.
Figure 1C:
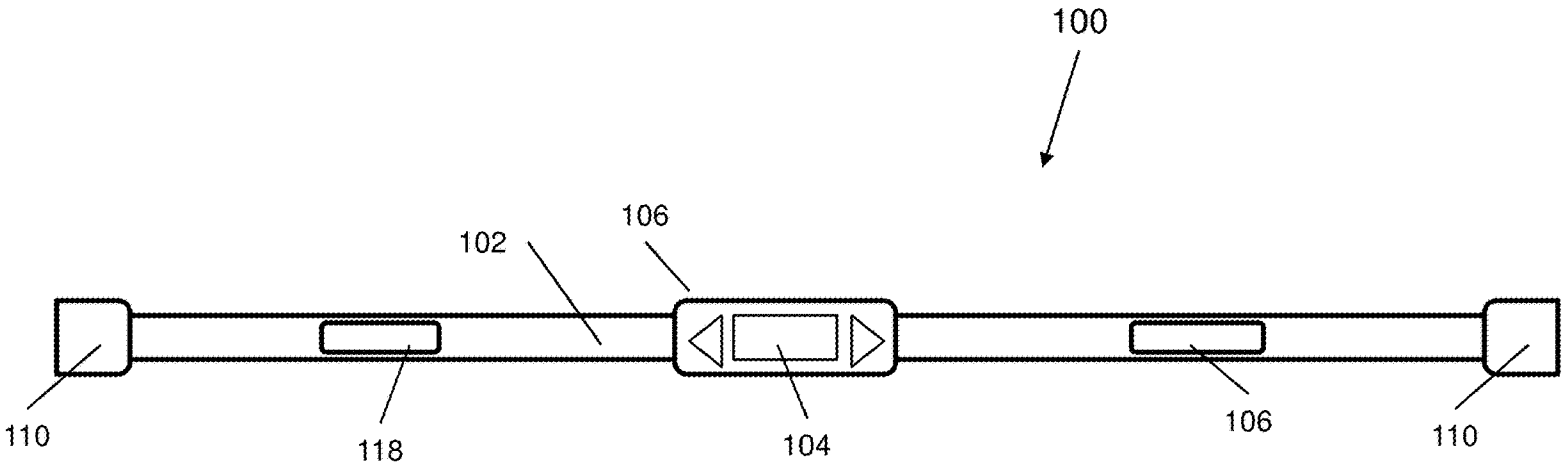
FIG. 1C shows an embodiment of a safety belt as it would appear when laid flat.

The safety belt 100 depicted in FIGS. 1A-1C includes a strap 102, a rear multi-functional light source 104, a right side multi-functional light source 106, and a left side multi-functional light source 108. The safety belt additionally includes a buckle 110 that makes it possible to fasten the safety belt around an individual's waist (or other body part). The buckle 110 is not critical to the inventive subject matter. FIG. 1B shows the embodiment of the safety belt of FIG. 1A as it would appear on an individual riding a bicycle. FIG. 1C shows the same embodiment as it would appear when laid flat. As used herein, the term "safety belt" should be construed to include belts positioned anywhere on the torso, hips, head or extremities.

Using an onboard computer in conjunction with one or more sensors, safety belts of the inventive subject matter can detect a kinematic status of the individual wearing the safety belt. A kinematic status can describe a movement or movements of an individual at a particular time. A kinematic status can also describe a movement or movements of an individual over a period of time (e.g., a time series of kinematic statuses, a running average based on a time series of kinematic statuses, or any other type of useful mathematical manipulation of a time series of data collected from one or more sensors). It is contemplated that the computer function could be off-loaded to an external device, as for example, a cell phone or other electronic device carried by the individual using the safety belt, or a cloud device. In any of those cases, signals to/from the belt could be transmitted using a wireless communication module.

Figure 2:
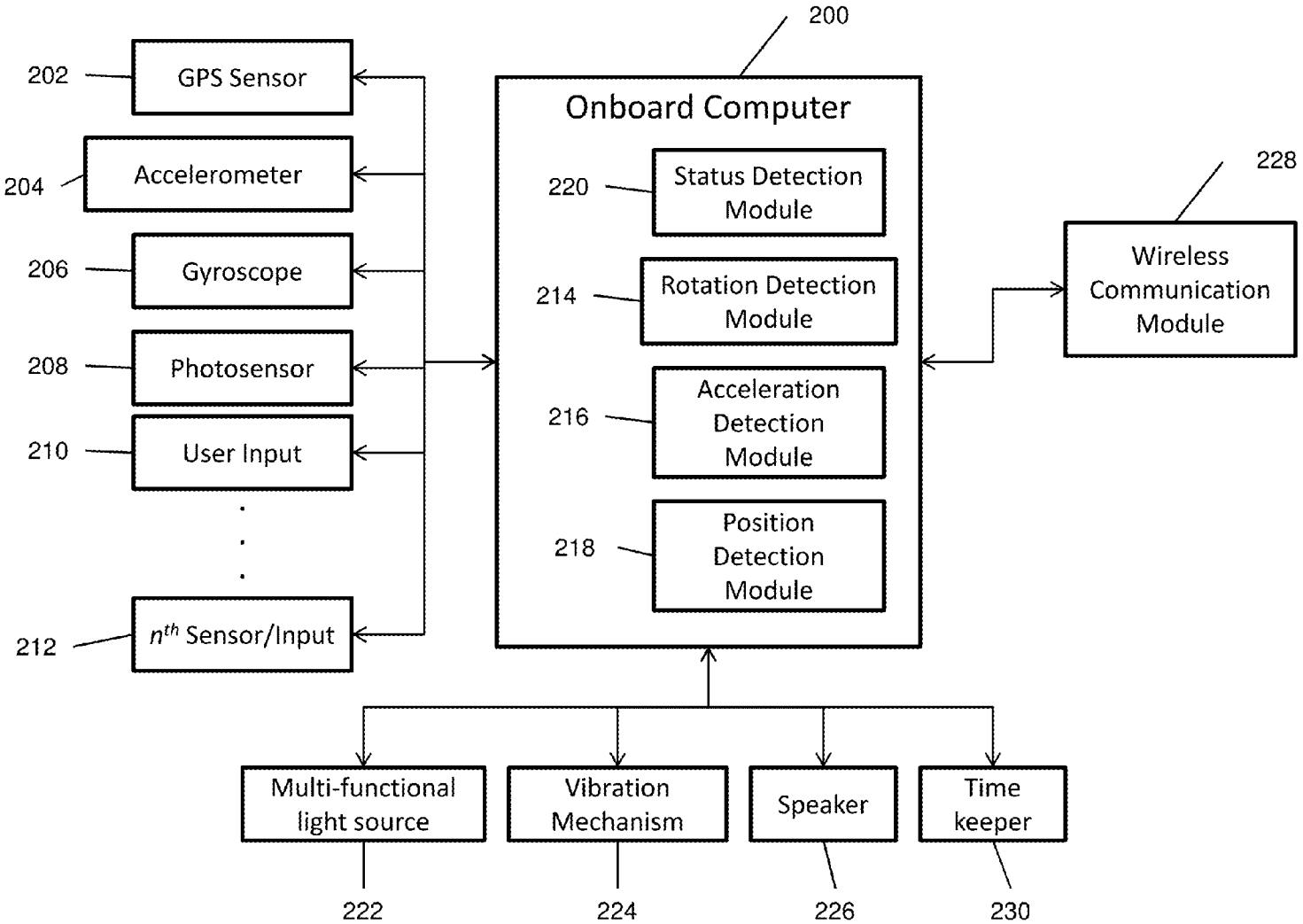
FIG. 2 shows a schematic of different electronic components that can be coupled with an embodiment of the safety belt's onboard computer.

FIG. 2 shows an example of an onboard computer 200 that can be implemented within an embodiment of the safety belt (e.g., safety belt 100). An onboard computer can be configured to communicate with a GPS sensor 202, an accelerometer 204, a photosensor 206, a gyroscope 608, user input 610, or any other sensor known in the art 212 (e.g., up to n number of sensors). One or more of any of these sensors can be implemented. For example, some embodiments could include an accelerometer on each side of the safety belt, or a gyroscope on each side of the safety belt. This can improve accuracy of information coming from those sensors by, for example, averaging the readings from each set of sensors.

To determine a kinematic status from these sensors, the onboard computer 200 includes or is coupled to, at least one of a rotation detection module 214, an acceleration detection module 216, and a position detection module 218, any of which can be implemented in hardware, software, or combination of hardware and software. The onboard computer 200 can also include a status detection module 220 that interprets the kinematic status of the safety belt as measured by the various sensors 202, 204, 206, 208, 210, & 212. The onboard computer can also be configured to communicate with a time keeper 230 (e.g., a clock, stopwatch, or timer).

When a kinematic status is interpreted by the status detection module 220 to meet a criterion to generate an alert, the onboard computer 200 then causes an alert to be generated by at least one of the multi-functional light source(s) 222, the vibration mechanism 224, or the speaker 226. In some embodiments, the onboard computer 200 can also be configured to communicate with a wireless communication module 228 that can be configured to communicate via WiFi, Bluetooth, infrared, or any other wireless mode of communication known in the art.

In embodiments of contemplated safety belts that include a wireless communication module, alerts that are triggered by various sensors can be broadcast to other devices. In some embodiments, the safety belt would be capable of networking within a group of users. The wireless communication module could be coupled with a location module (e.g., a GPS sensor) to allow alerts to be broadcast among the group of users (e.g., if one user gets separated from the group, if a user's belt is in panic or emergency mode).

Kinematic status is expressed electronically, based on the sensor or sensors included in the safety belt. For examples of the types of sensors that can be included, see the discussion above in relation to FIG. 2. In embodiments with an accelerometer, kinematic status can expressed as a vector (e.g., acceleration expressed in a coordinate system such as a Cartesian coordinate system). Similarly, in an embodiment with a gyroscope, rotation can be expressed as a vector (e.g., rotation about various axes of a coordinate system, for example a Cartesian coordinate system). In embodiments with both an accelerometer and a gyroscope, kinematic status is expressed as one or more vectors or arrays representing both accelerations along various axes of a coordinate system as well as rotations about those same axes.

In addition to expressing an instantaneous status, kinematic status can also be based on one or more time series of data collected from the sensor or sensors on a safety belt. By tracking a time-based series of kinematic statuses, a processing unit (e.g., a CPU or other microcontroller) can interpret that series of statuses to determine a present kinematic status that takes into account not only instantaneous conditions, but also kinematic status trends to develop a more accurate interpretation of an individual's actions.

Figure 3:
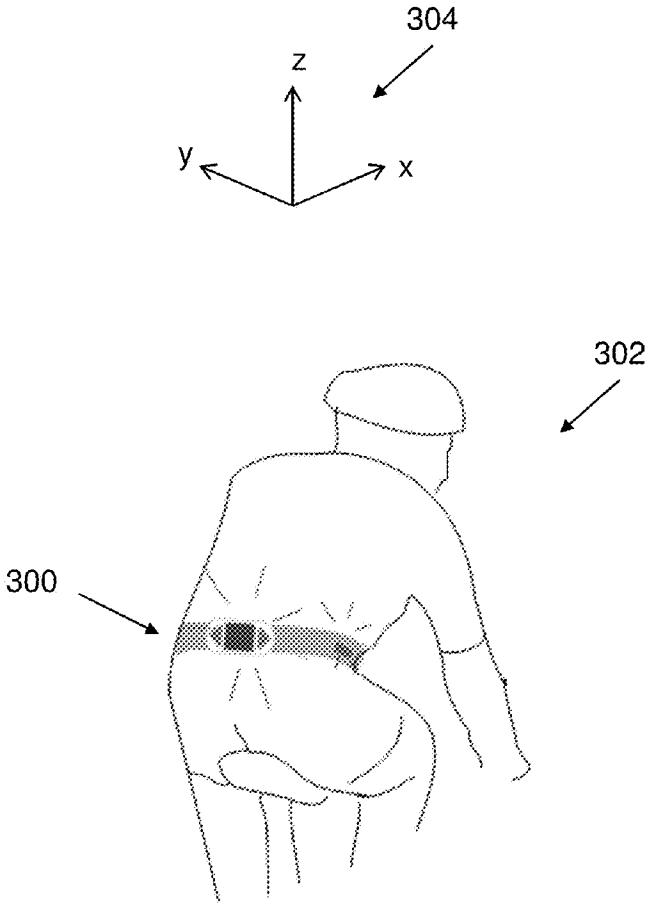
FIG. 3 shows an embodiment of the safety belt during as it exists when a person on a bicycle is stopped.

FIG. 3 shows an individual on a bicycle and wearing a safety belt 300. The individual 302 in FIG. 3 is not moving, which is represented by that user's kinematic status. While the safety belt shown in FIG. 3 is depicted as being worn by a cyclist 302, it is contemplated that safety belts of the inventive subject matter can be worn by individuals participating in a wide variety of different activities including walking, running, cycling, swimming, kayaking, rowing, etc. As shown in FIG. 3 (i.e., the individual is not moving), the individual's kinematic status would indicate nominal acceleration or change in acceleration (outside of a reading for gravity) and nominal rotation or change in rotation according to the reference frame above the cyclist 304.

Small measurements and variations in acceleration and rotation caused by natural movements of the individual can either be filtered out or ignored. For example, gravity can be filtered out or reduced in a kinematic status. Since the absence of acceleration or rotation does not necessarily indicate the individual is not moving, a kinematic status based on a time series of data can be additionally be used to infer that an individual is not moving as opposed to traveling at a constant velocity (e.g., coasting on a bicycle).

In some embodiments, lack of movement can be distinguished from movement at a constant speed by cyclical changes in acceleration or rotation that are associated with repeated movements (e.g., pedaling a bicycle, walking, running, paddling a boat, etc.). And in the absence of such cyclical changes in acceleration and rotation (e.g., coasting on a bicycle), lack of movement can be distinguished from movement at a constant speed by looking at a time series of kinematic statuses to determine whether the individual wearing the safety belt is moving or not. Additionally or alternatively, a GPS sensor can contribute information to determine whether the safety belt is moving.

Figure 4:
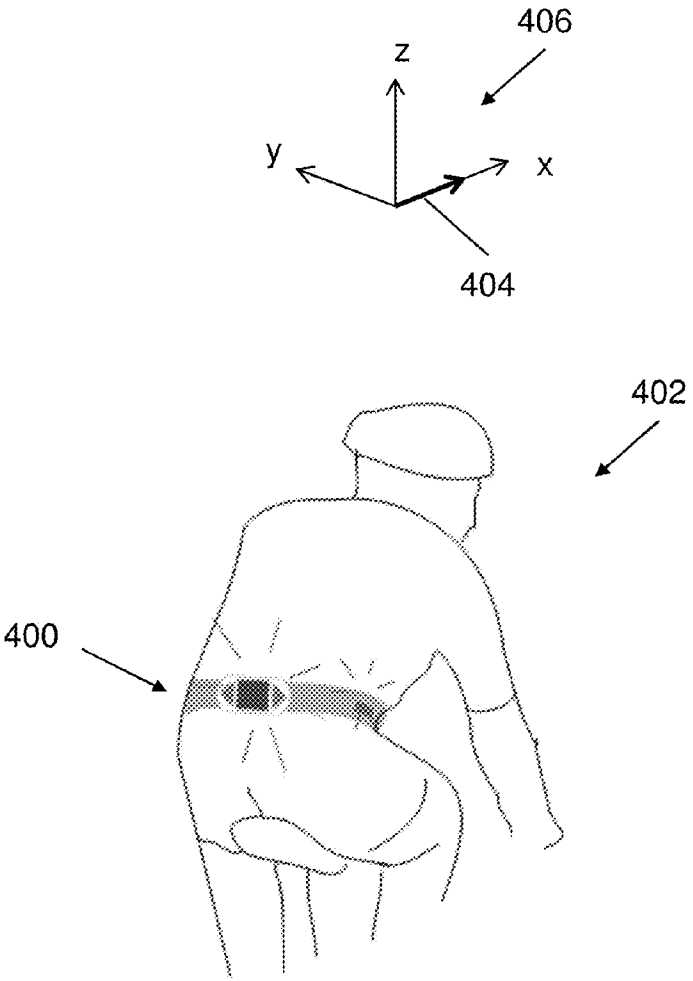
FIG. 4 shows an embodiment of the safety belt during as it exists when a person on a bicycle is accelerating forward.

Kinematic status can indicate acceleration (e.g., acceleration in any direction) experienced by an individual 402 wearing an embodiment of the safety belt 400. In FIG. 4, an accelerometer detects acceleration 404 (depicted as an arrow in bold along the x-axis) in primarily the x-direction as expressed in the Cartesian coordinate system 406 depicted above the depiction of the cyclist 402 wearing the safety belt 400. Although forward acceleration of a bicyclist 402 would inevitably include measurable accelerations in a variety of different directions due to the effort expended by pedaling and natural movements of the body that result, acceleration would primarily be experienced in the positive x-direction.

Figure 5:
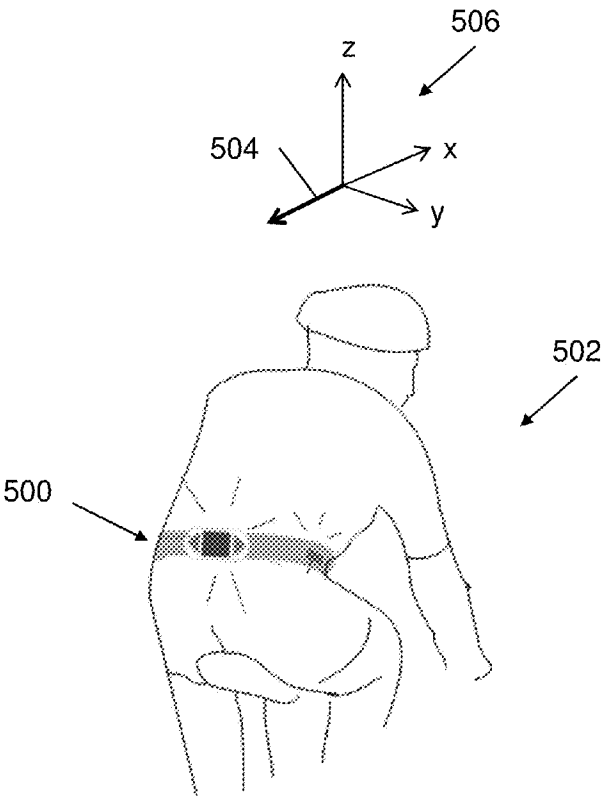
FIG. 5 shows an embodiment of the safety belt during as it exists when a person on a bicycle is decelerating.

Similarly, if a person (e.g., a cyclist as seen in FIG. 5) wearing the safety belt 500 slows down, an accelerometer in the safety belt would experience an acceleration primarily in the negative x-direction 504 as defined by the coordinate system shown above the rider 406. Even in situations where an accelerometer measures acceleration along either the y- or z-axes in combination with a measured acceleration along the x-axis, the acceleration along the x-axis would nevertheless indicate either acceleration or deceleration of the rider 402.

A kinematic status can also indicate either intent to make a turn or the act of turning (e.g., on a bicycle). By measuring accelerations and/or rotations about various axes of a coordinate system, intent to turn or a turn can be detected. In some embodiments, detection of these conditions in conjunction with a duration of time In FIG. 6, a cyclist 602 is shown wearing an embodiment of the safety belt 600, whereby the cyclist 602 has initiated a turn. By initiating a turn, the cyclist 602 has leaned to a side (e.g., leaning to his left or right), causing a rotation of the safety belt primarily about the x-axis as shown by the rotation marker 604 in the coordinate system depicted above the cyclist 606.

Figure 6:
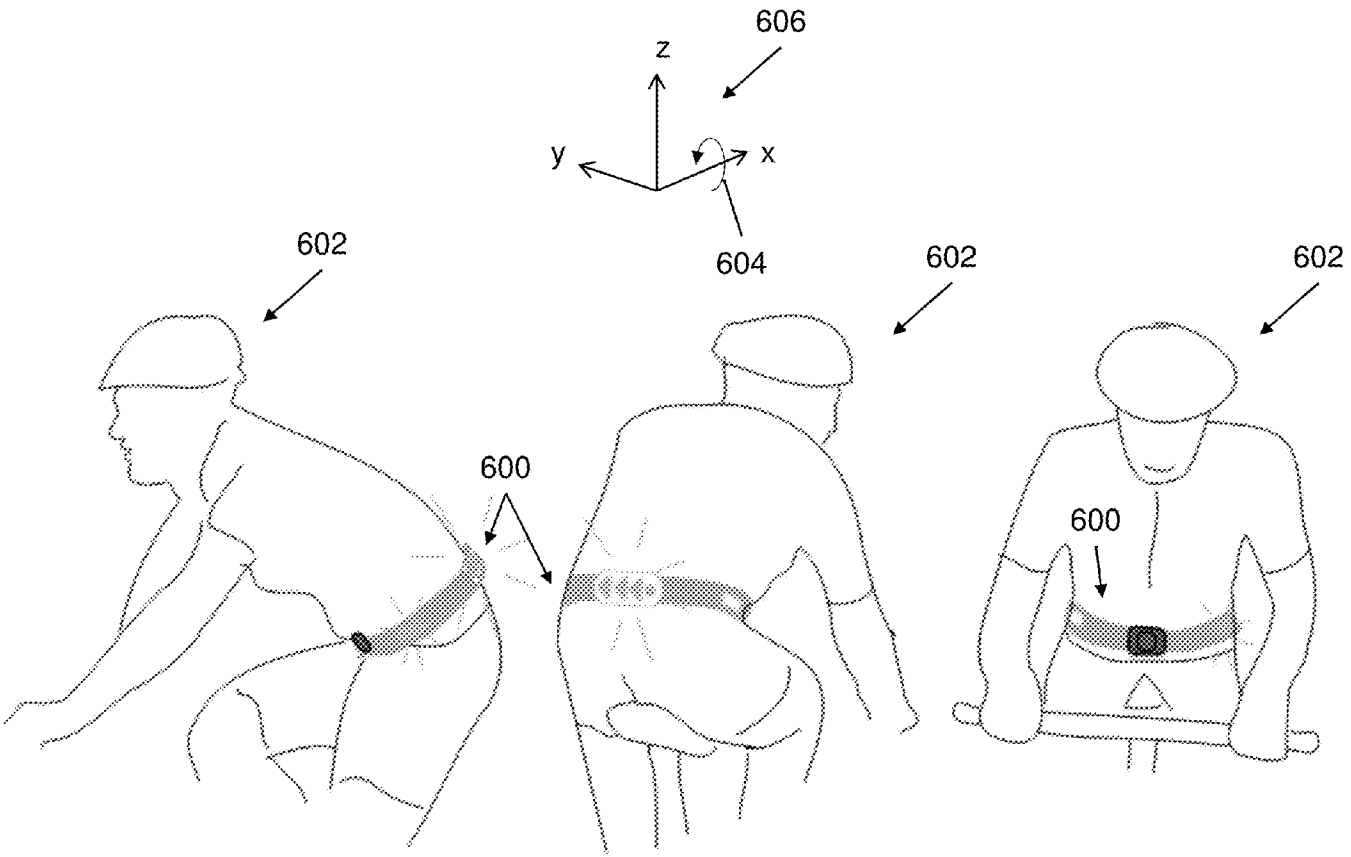
FIG. 6 shows an embodiment of the safety belt during as it exists when a person on a bicycle is turning left.

Rotation indicative of a turn can be measured in at least two ways. Rotation can be measured by observing an acceleration vector associated with gravity and determining how that vector changes relative to its initial state (e.g., observing changes in kinematic status over time to determine whether the wearer of the safety belt has leaned to a side). Rotation can also be measured using a gyroscope that directly measures a rotation or a change in rotation over time. As seen in FIG. 6, when the cyclist leans to a side (e.g., the left), a gyroscope measures rotation primarily about the x-axis. This rotation (and/or change in angular position) is expressed in the individual's kinematic status.

Additionally or alternatively, one, all, or some combination of an accelerometer, a gyroscope, a photosensor, manual input, a GPS sensor, and any other sensor included with the safety belt can be used to determine a kinematic status indicating a turn. Turn signal triggering, in some embodiments, is automatic, while in other embodiments it is manually accomplished. In still further embodiments, some combination of manual and automatic input determines when a turn signal should be turned on or off.

In some embodiments, turn signals are automatically triggered by a bike rider beginning to turn (e.g., a kinematic status indicating this condition). The turn signal would turn on for the duration of the turn and then turn back off. The can be accomplished using a timer or a measured kinematic status. Additionally or alternatively, turn signals are triggered by a combination of a lean or turn detected by, for example, the accelerometer and gyroscope, in conjunction with an elapsed time (e.g., if a lean occurs for a certain duration of time, for example 0.5 seconds or 1 second, the signal will turn on, and it will turn off when the lean stops). In still further embodiments, a turn signal can be triggered by a sudden acceleration, a rotation or sudden rotation, a center of mass change, or a gesture from the safety belt wearer (e.g., a hand wave or head turn).

Turn signal triggering can also be adaptive. For example, if a person is riding a bicycle on a mountainous road, the sensors in the safety belt could detect that the rider is frequently turning, changing inclinations, pedaling hard, coasting, or some combination thereof. All of these actions can affect the signals generated by sensors on the safety belt. In detecting this information, triggering for turns, as well as other behaviors of the safety belt, can be adjusted (e.g., automatic turn signal sensitivity can be decreased or increased as needed).

It is additionally contemplated that turn signaling can be triggered when coming to a stop so that people around the safety belt wearer know where that person intends to go upon resuming motion (e.g., a turn signal is turned on when at a stop light). Such a turn signal can be triggered in any manner described above.

Kinematic status can also include a geographic position of the safety belt. Position can be determined using, for example, a GPS device. Position of the safety belt, and by extension the position of the individual wearing the safety belt, can be incorporated into both an instantaneous kinematic status as well as a time series of kinematic statuses. When looking at a time series of kinematic statuses that include position, those kinematic statuses can, for example, show where a person walked or rode their bike and then overlay that data on a map.

Although each of the examples above focus on making use of a particular sensor (e.g., accelerometer or gyroscope) to determine a kinematic status, it is contemplated that kinematic status can be determined using a combination of all of the sensors that are coupled with the onboard computer. Once a kinematic status is determined by the onboard computer's status detection module, the onboard computer can cause the multi-function light sources to indicate the detected kinematic status.

Figure 7:
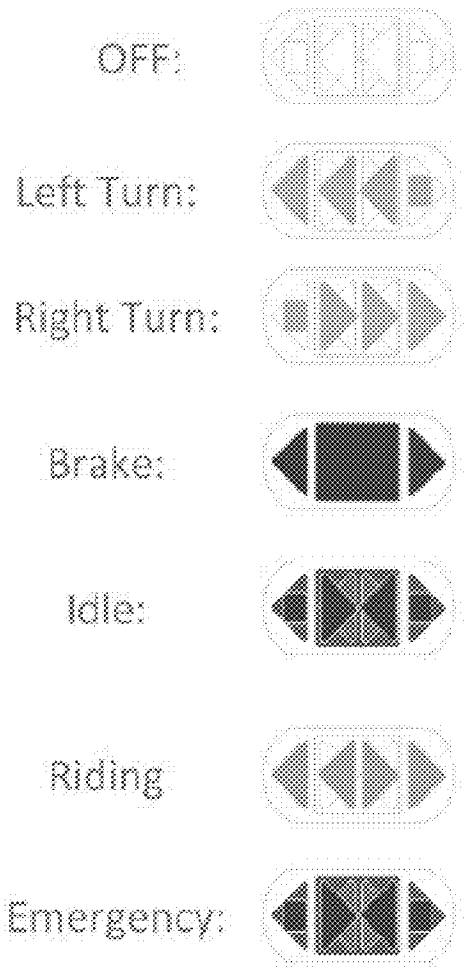
FIG. 7 shows different ways the rear facing multi-function light source can appear based on different kinematic statuses.
Figure 8B:
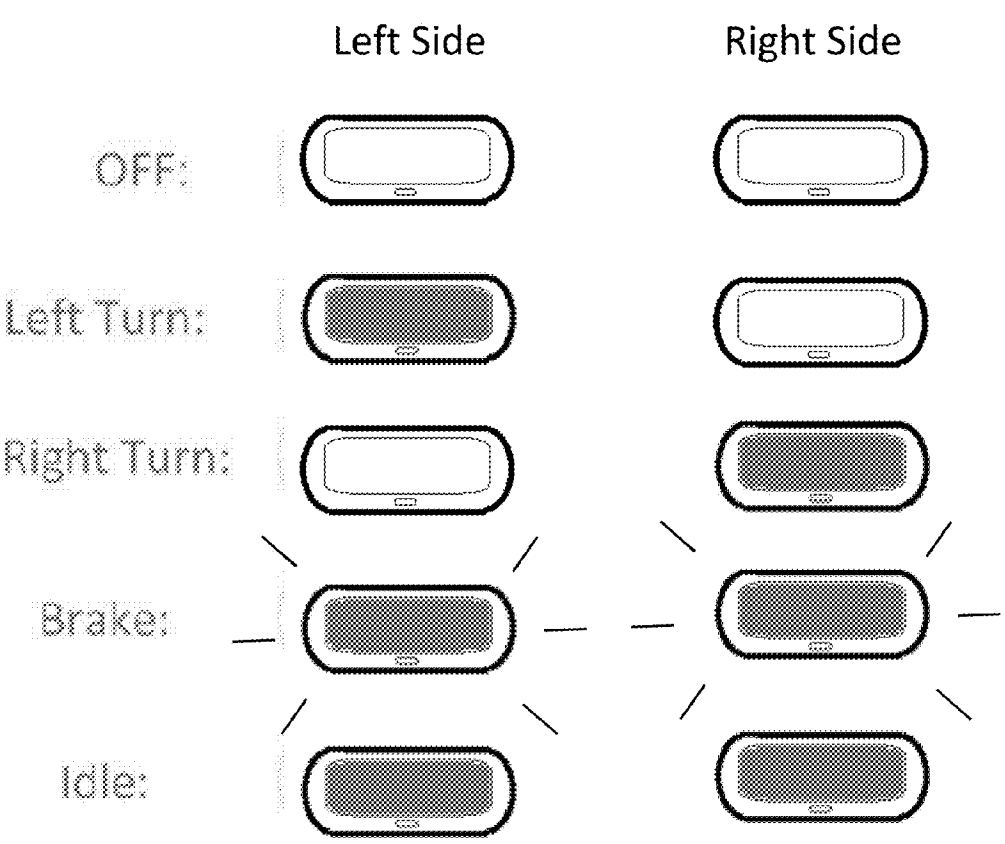
FIG. 8B shows different ways the side facing multi-function light source can appear based on different kinematic statuses.
Figure 8A:
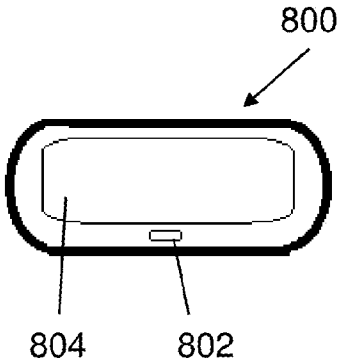
FIG. 8A shows an embodiment of a multi-function light source that would attach to the side of a safety belt.

FIG. 7 shows how the rear multi-function light source can indicate different kinematic states, including for example, a left turn, a right turn, braking, idling, riding, and an emergency. The kinematic status corresponding to each of these conditions can also inform the intensity of the indication (e.g., the multi-functional light source can blink faster or slower depending on the magnitude of an acceleration, rotation, or both). In addition, different colors can be used depending on the kinematic condition. For example, green can indicate acceleration forward, yellow can indicate deceleration, and red can indicate a stop. FIG. 8A shows an embodiment of a multi-function light source 800 that would attach to the side of a safety belt of the inventive subject matter. It can include a user input 802 (e.g., a sensor to detect a tap, or a button) and a light panel 804 (e.g., LEDs, and LCD screen, or the like). FIG. 8B shows indications for off, left turn, right turn, brake, and idle as they would appear on a multi-function light panel on the side of an embodiment of the safety belt.

An emergency alert is a warning that is broadcast either locally or remotely to indicate that conditions exist that are cause for alarm (e.g., a person wearing a safety belt has been hit by a car, gotten lost, etc.). To trigger an emergency alert indication, for example, a person could be hit by a car while wearing the safety belt. In the course of the accident, that person's kinematic status would indicate that the person experienced an amount of acceleration and/or rotation that they could not reasonably produce by themselves (e.g., by walking, by riding a bike, or even by riding in a car).

Triggering thresholds can be tuned to prevent false positives, by, for example, taking into account that a person may toss their safety belt down when they are finished using it. Additionally, use of multiple sensors can help to reduce false positives by, for example, requiring both sudden rotation and sudden acceleration before generating an alert. When an emergency alert is triggered, that information can be immediately broadcast by the wireless communication module, or a record of the alert can be kept in the onboard computer for later retrieval. False positive detection is also handled by the onboard computer.

Figure 9:
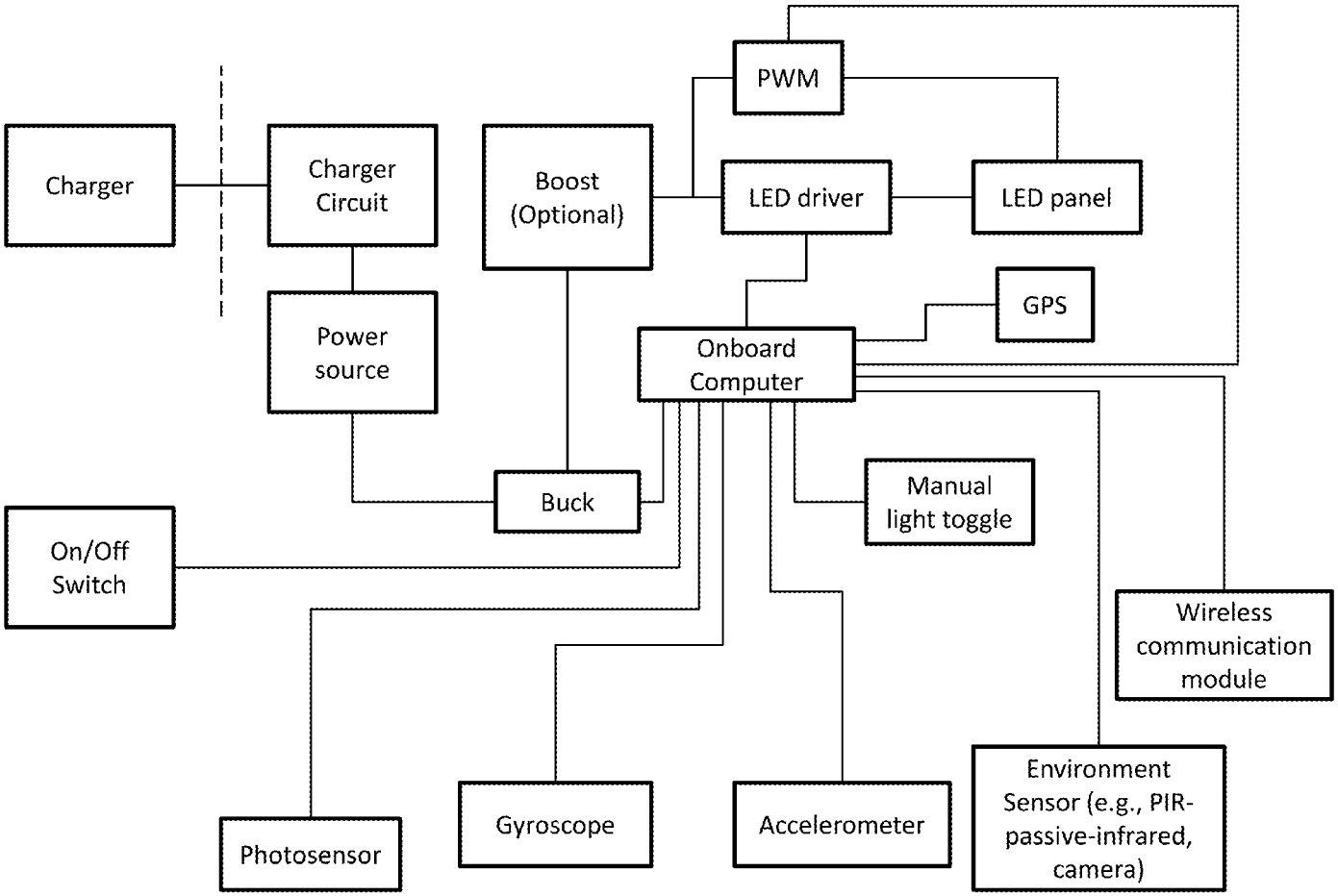
FIG. 9 shows a schematic of electronic components that can be implemented in the safety belt.
Figure 10:
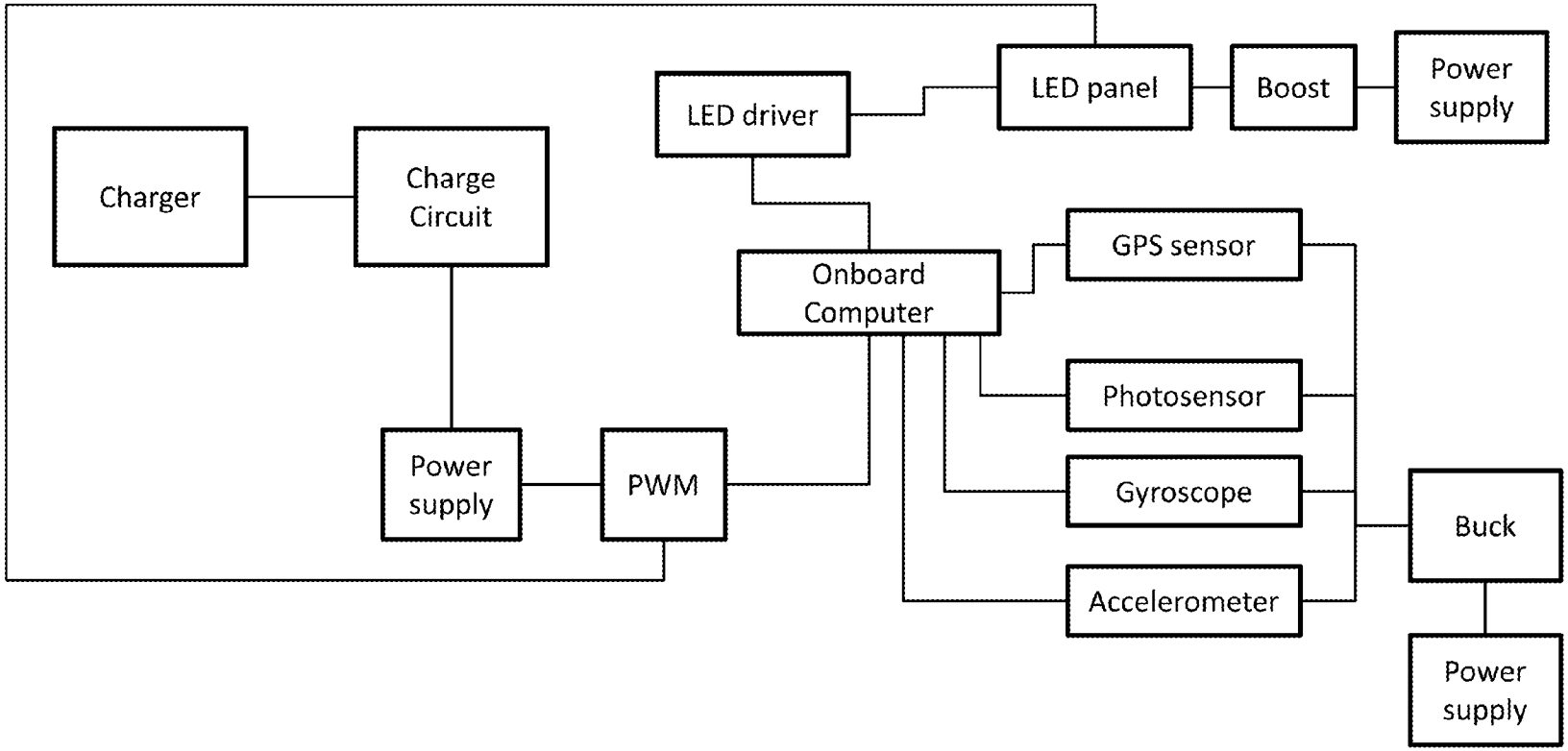
FIG. 10 shows another schematic of electronic components that can be implemented in the safety belt.

FIG. 9 shows an example configuration of the various components that can be included within a safety belt according to the inventive subject matter. It includes among other components, an accelerometer, a gyroscope, and a photosensor. Notably, not all of the sensors/inputs shown in FIG. 9 are necessary—a subset of any of the listed components can be included to create various embodiments of the safety belt. FIG. 10 similarly shows another example configuration of the various components that can be included within a safety belt according to the inventive subject matter.

In addition to the features discussed above, safety belts of the inventive subject matter can additionally include the features described in more detail below. In some embodiments, the safety belt can utilize its wireless communication module to network between a child user and a parent such that the safety belt, via the wireless communication module, would alert the parent if the child has departed from a particular area. The safety belt could also be used by a teacher to maintain control of a group of students. For example, a student's belt would broadcast an alert to the teacher if the student got separated from the group or wandered too far. Other sensors are contemplated that can determine positional information, for example gyroscopes and accelerometers. Additionally, the wireless communication module would allow a user to easily join and change networks.

In another embodiment, the safety belt could also include light coordination between users in the same network. The wireless communication module would broadcast a signal to the other belts in the network such that the multi-purpose light sources on each belt would flash on and off in any particular pattern or sequence or color variety all together. This feature is designed to allow the group to be spotted by pedestrians or vehicles. Furthermore, the wireless communication module could be coupled to a microphone and speaker on each belt to allow verbal communication between belt users in a network. The safety belt could also include Bluetooth to allow a user to connect a wireless device to perform various functions (e.g., transmit data wirelessly, listen to music, sync to a mobile device, etc.).

In still further embodiments, a GPS sensor can be used to trigger alerts. For example, an alert can be triggered if: the safety belt stops moving for a period of time (e.g., when a child is supposed to be walking home from school but stops for a threshold amount of time); the safety belt begins moving too fast (e.g., if a child wearing a safety belt is supposed to be walking home, but they get into a car when they aren't supposed to); the safety belt is detected to go to a forbidden location (e.g., a location predefined to be off-limits, for example an arcade or a friend's house). In addition, the GPS sensor can be used in conjunction with any other alert described in this application by broadcasting the location of the safety belt upon triggering an alert.

Finally, in some embodiments, an alert can be triggered manually by a user (e.g., via a button press or a combination of button presses). Upon triggering a manual alert, information about the safety belt (e.g., sensor information, information collected over the past 5 minutes) can be broadcast via the wireless communication module.

In addition to the possible applications mentioned above, the safety belt can additionally be used by road workers, emergency crews, and police officers. Not only can the safety belt increase visibility of its wearer, its alert system can ensure that if something goes wrong, that individual is helped as quickly as possible. In instances where a group of safety belts are networked together and one of the group produces an alert, each of the nearby safety belts can receive the alert so the wearer can make sure the person whose belt generated the alert is okay.

In some aspects of the inventive subject matter, the safety belt incorporates environmental awareness. For example, the safety belt can use its sensors (e.g., a light sensor, a camera, a thermal sensor, a radar sensor, an acoustic distance sensor, a passive infrared sensor (PIR), etc.) to detect a hazard (e.g., people, animals, cars, or any other objects that might be moving towards the individual wearing the safety belt in a way that may be threatening or alarming to the wearer). In some embodiments, the sensors on a safety belt can detect hazards that are 10-15, 15-20, 20-25, 25-30, 30-40, and 40-50 yards out.

Upon detecting an object moving toward a safety belt wearer that additionally triggers an alert condition (e.g., the object is moving faster than a threshold speed, the object has a certain heat signature, or the object is a certain size), the safety belt can be set into a panic mode (e.g., it can act as a siren, it can vibrate, and/or it can broadcast multicolor emergency lighting). This will alert both the safety belt wearer of the danger, and it will catch the attention of any other person, animal, or sensor in the vicinity. For example, if the safety belt detects a car moving toward it, it can activate its lights and vibrate to alert the wearer to move alert the driver of the car to take an action. Alerts generated in this context can also be broadcast wirelessly to other safety belt(s) or computing device(s).

In embodiments where the safety belt uses a camera to detect an incoming danger, a night mode can also be included such that the camera detects, for example, infrared light. In some embodiments, more than one sensor can be used to detect more of a safety belt wearer's surroundings. In some embodiments, the light sensor can detect vehicle headlights shining onto the safety belt wearer. Upon detecting headlights, the safety belt can be programmed to, for example, start flashing, increase intensity, increase flashing rate, and/or increase color variety to grab the driver's attention. This form of "active reflectivity" can be compared to "passive reflection" that is accomplished by using normal, reflective materials. In some embodiments, instead of light sensors, the safety belt uses one or more cameras or other sensors, but in still further embodiments, the safety belt incorporates both light sensors and cameras. Active reflectivity is especially advantageous during activities like trick or treating when children are more likely to be out in the street at night.

In further embodiments, the location module could be programmed with a "home" location such that when the user arrives at this location, the safety belt automatically turns off. The location module could also be programmed with "high crime area" location information. Upon moving too close to a high crime area, a user could be notified. In some embodiments, if a user moves to an area with high crime rate (detected with GPS data) the safety belt increases the sensitivity of its camera/sensor to more readily detect approaching objects.

In addition to all of the functions described above, the inventors contemplate that other embodiments of the safety belt can incorporate still further functionalities. In some embodiments, the safety belt includes a clock. The clock can either include a visual display, or it can have the ability to broadcast the time using a speaker or by wirelessly broadcasting it to a companion device. Additionally or alternatively, the safety belt can be configured to turn on when a user puts it in (e.g., triggered by buckling, by sensing body heat, by sensing that it is around someone's waist).

In some embodiments, a safety belt is set up for only a single intended use (e.g., walking or biking), and the features included on such a safety belt are selected based on the needs of the intended activity. But the inventors also contemplate that a single safety belt can include a number of different modes, including walking and biking, which can be selected either manually or automatically. In some embodiments, the safety belt can additionally include various pouches to hold, for example, keys, a phone, and/or a water bottle. Manual selection can be accomplished by, for example, button press, while automatic selection can be accomplished by interpreting information from onboard sensors (e.g., to detect whether a person is walking or biking).

Finally, the inventors contemplate that all of the features described in this application could be incorporated into other form factors including bags, luggage, clothing, etc.

As used in this application, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

Unless the context dictates the contrary, all ranges set forth in this application should be interpreted as being inclusive of their endpoints and open-ended ranges should be interpreted to include only commercially practical values. Similarly, all lists of values should be considered as inclusive of intermediate values unless the context indicates the contrary.

As used in the description in this application and throughout the claims that follow, the meaning of "a," "an," and "the" includes plural reference unless the context clearly dictates otherwise. Also, as used in the description in this application, the meaning of "in" includes "in" and "on" unless the context clearly dictates otherwise.

The recitation of ranges of values in this application is merely intended to serve as a shorthand method of referring individually to each separate value falling within the range. Unless otherwise indicated in this application, each individual value with a range is incorporated into the specification as if it were individually recited in this application. All methods described in this application can be performed in any suitable order unless otherwise indicated in this application or otherwise clearly contradicted by context. The use of any and all examples, or exemplary language (e.g. "such as") provided with respect to certain embodiments in this application is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed in this application are not to be construed as limitations. Each group member can be referred to and claimed individually or in any combination with other members of the group or other elements found in this application. One or more members of a group can be included in, or deleted from, a group for reasons of convenience and/or patentability. When any such inclusion or deletion occurs, the specification is in this application deemed to contain the group as modified thus fulfilling the written description of all Markush groups used in the appended claims.

It should be apparent to those skilled in the art that many more modifications besides those already described are possible without departing from the inventive concepts in this application. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A safety belt to improve visibility of an individual, comprising:

a strap;

a multi-functional light source coupled to the strap; and at least one sensor; and a processing unit informationally coupled with the multi-functional light source and the at least one sensor, the processing unit programmed to:

receive a signal from the sensor corresponding to a kinematic status of at least one of (a) a sensed rotation about an axis along a direction of travel and (b) a sensed change in angular position;

automatically determine that the received kinematic status corresponds to an initiation of a turn by the individual; and in response to determining that the kinematic status corresponds to the initiation of the turn, cause the multi-functional light source to generate a light signal indicative of the direction of the initiated turn.

2. The safety belt of claim 1, further comprising a wireless communication device configured to broadcast the kinematic status.

3. The safety belt of claim 1, wherein the at least one sensor comprises at least one of an accelerometer, and a gyroscope.

4. The safety belt of claim 1, wherein the at least one sensor further comprises at least one of a GPS sensor and a photosensor.

5. The safety belt of claim 1, wherein the multi-functional light source comprises at least one of an array of LEDs and a digital display.

6. The safety belt of claim 1, further comprising second and third multi-functional light sources that are coupled to the strap.

7. The safety belt of claim 1, wherein the processing unit is programmed to automatically determine the initiation of the turn by the individual based on the received kinematic status and a measured time that the kinematic status has been maintained.

8. A method of improving visibility of an individual wearing a safety belt, comprising the steps of:

detecting, using a sensor coupled to the safety belt, a kinematic status of the individual, the kinematic status of the individual comprising at least one of (a) a sensed rotation about an axis along a direction of travel and (b) a sensed change in angular position;

automatically determining, by a processing unit, that the kinematic status corresponds to an initiation of a turn by the individual; and in response to determining that the kinematic status corresponds to the initiation of the turn, causing, by the processing unit, a multi-functional light source to generate a light signal indicative of the direction of the initiated turn.

9. The method of claim 8, further comprising the step of wirelessly broadcasting the kinematic status of the individual via a wireless communication device.

10. The method of claim 8, wherein the at least one sensor comprises at least one of an accelerometer, and a gyroscope.

11. The method of claim 8, wherein the at least one sensor further comprises at least one of a GPS sensor and a photosensor.

12. The method of claim 11, wherein the photosensor detects at least one of visible light, infrared light, and ultraviolet (UV) energy.

13. The method of claim 8, wherein the multi-functional light source comprises at least one of an array of LEDs and a digital display.

14. The method of claim 8, further comprising the step of activating second and third multi-functional light sources that are informationally coupled to the sensor so that the second and third multi-functional light sources indicate the initiated turn.

15. The method of claim 8, wherein the automatically determining step further comprises determining, by the processing unit, the initiation of the turn by the individual based on the received kinematic status and a measured time that the kinematic status has been maintained.

* * * * *